US005439273A

United States Patent [19]

Price et al.

[11] Patent Number: 5,439,273

[45] Date of Patent: Aug. 8, 1995

[54] CONCRETE BREAKER AND METHOD

[75] Inventors: Robert E. Price, Grand Rapids; James R. Trutsch, Middleville, both of Mich.

[73] Assignee: Price Industries, Inc., Dutton, Mich.

[21] Appl. No.: 234,272

[22] Filed: Apr. 28, 1994

[51] Int. Cl.[6] ..... E01C 23/12; E21C 27/12

[52] U.S. Cl. ..... 299/37; 173/28; 404/133.1

[58] Field of Search ..... 299/37, 69; 404/90, 404/133.1, 133.05; 173/28; 241/101.7

[56] References Cited

U.S. PATENT DOCUMENTS

| | | | |
|---|---|---|---|
| 2,254,477 | 9/1941 | Ferguson | 299/37 X |
| 2,587,969 | 3/1952 | Cornett | 299/37 X |
| 2,659,583 | 11/1953 | Dorkins | 404/133.1 X |
| 2,659,584 | 11/1953 | Dorkins | 404/133.05 X |

OTHER PUBLICATIONS

Exhibit A are photographs disclosing a known prior art concrete breaker mounted on a truck bed. (undated).

Exhibit B is a product brochure entitled "E-Z Breaker", (publication date unknown), published by Chief Industries, Inc., Grand Island, Neb.

Exhibit C is a product brochure entitled "Fairmont Hydraulics Has Gotten Bigger . . . and Better", (publication date unknown) published by Greenlee Textron Inc., Fairmont, Minn.

Exhibit D is a product brochure entitled "New Drop Hammer", (publication date unknown) published by Rockford Industries, Inc., McAlester, Okla.

*Primary Examiner*—David J. Bagnell

*Attorney, Agent, or Firm*—Price, Heneveld, Cooper, DeWitt & Litton

[57] ABSTRACT

A concrete breaker includes a wheeled frame having front and rear wheels, a blade frame pivotally mounted to the wheeled frame between the front and rear wheels, and a heavy concrete breaking blade slideably mounted to the blade frame for busting concrete. The blade frame is pivotally moveable by a hydraulic cylinder assembly over-center to a stable transport position, and further is moveable over-center to an upright position on the wheeled frame for use. Wheels on the blade frame rest on the concrete being broken and support the operating weight of the blade frame and the blade when the blade is in use. The blade frame is moveable relative to the wheeled frame to reduce transmission of vibration from the blade and blade frame to the wheeled frame. The hydraulic cylinder assembly is connected between the blade frame and the wheeled frame and acts as a draw-bar-like member during use of the concrete breaker to overcome torsional forces on the blade frame as wheels on the blade frame engage rough terrain such as broken or irregular concrete under the blade frame. A hydraulic system is connected to the blade to raise the blade to a lifted position, and includes a double line discharge to exhaust hydraulic fluid from the cylinder without restriction when the blade is hydraulically released and dropped onto the cement to break the cement.

35 Claims, 5 Drawing Sheets

CONCRETE BREAKER AND METHOD

BACKGROUND OF THE INVENTION

The present invention relates to construction equipment for breaking concrete, and in particular to a concrete breaker for busting concrete slabs into pieces to facilitate removal of the concrete, such as is commonly used in highway renovation.

Concrete breakers are often used to break up worn-out concrete sections of highway to facilitate removal of the concrete. A: common concrete breaker is a "guillotine" style breaker which includes a heavy blade that is repeatedly lifted and dropped against the concrete. In known guillotine style breakers, the heavy blade is slideably supported at the rear of the apparatus in a blade guide positioned ion the main frame for guiding the movement of the guillotine blade. However, the shocks and vibration generated by the blade contacting the concrete are transferred directly to the guides and to the main frame, causing considerable wear and tear to the frame and to other components mounted on the frame.

Usually, the blade is mounted on the rear of a heavy duty truck. However, there are smaller self-propelled units with drop hammers mounted over the rear wheels.

SUMMARY OF THE INVENTION

In the present invention, the blade frame is pivotally mounted to a wheeled frame between the front and rear wheels. A blade is movably connected to the blade frame, and is lifted and dropped to break concrete. The blade frame is moveable on the wheeled frame between an upright position for using the blade and a lowered transport position facilitating transport. In a preferred form, the blade frame includes wheels engageable with the terrain under the blade frame for supporting the working weight of the blade and the blade frame independent of the wheeled frame during use, and further the blade frame is preferably mounted about midway between the front and rear wheels on the wheeled frame for stability.

These and other features, advantages and objects of the present invention will be further understood and appreciated by those skilled in the art by reference to the following specification, claims and appended drawings.

DETAILED DESCRIPTION OF PREFERRED EMBODIMENT

Figure 3:
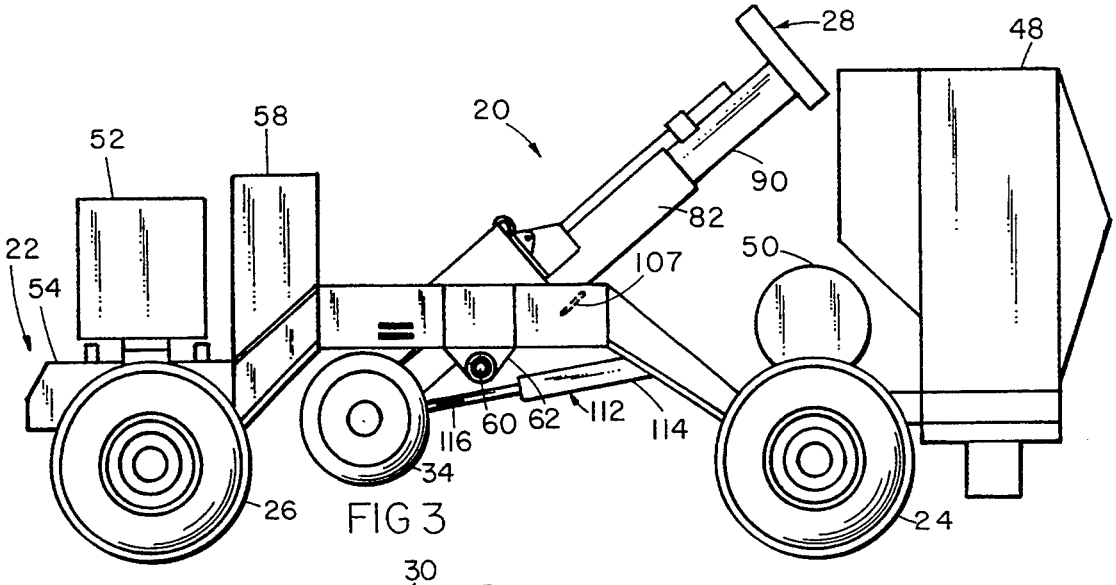
FIG. 3 is a side view of the concrete breaker with the blade and blade frame being shown in the inclined transport position.
Figure 1:
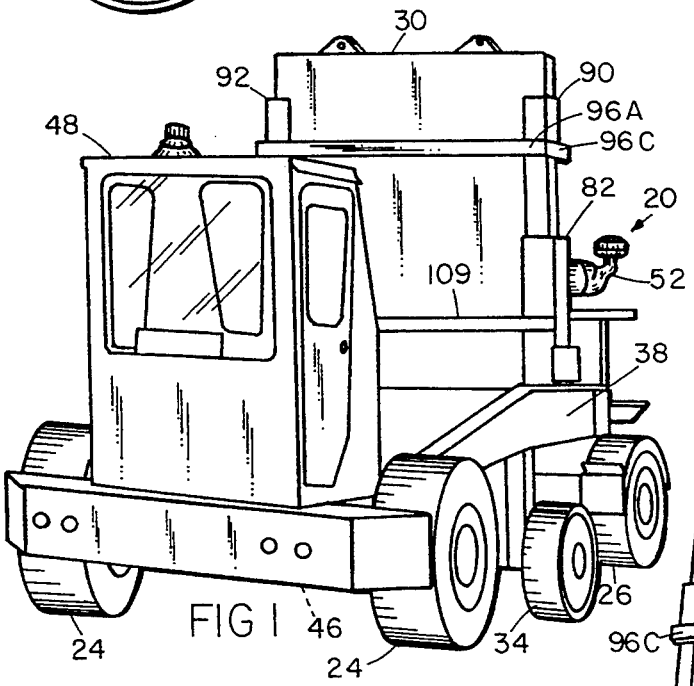
FIG. 1 is a front perspective view of a concrete breaker embodying the present invention, the blade and blade frame being shown in an upright position on the wheeled frame.

A concrete breaker 20 (FIGS. 1–3) includes a wheeled frame 22 having front and rear wheels 24 and 26. A blade frame 28 is pivotally mounted to the wheeled frame 22 generally midway between the wheels 24 and 26 for movement over-center between an upright/use position (FIGS. 1–2 and 4) and a storage/-transport position (FIG. 3). A "guillotine" style concrete breaking blade 30 is slideably mounted to blade frame 28 for engaging and busting up concrete 32. Blade frame 28 is independently supported by wheels 34 when in the upright position (FIGS. 1–2 and 4), and is slideably mounted to wheeled frame 22 such that it "floats" on wheeled frame 22 in a manner that reduces transmission of shocks and vibration from blade 30 to wheeled frame 22 during use of breaker 20.

Figure 5:
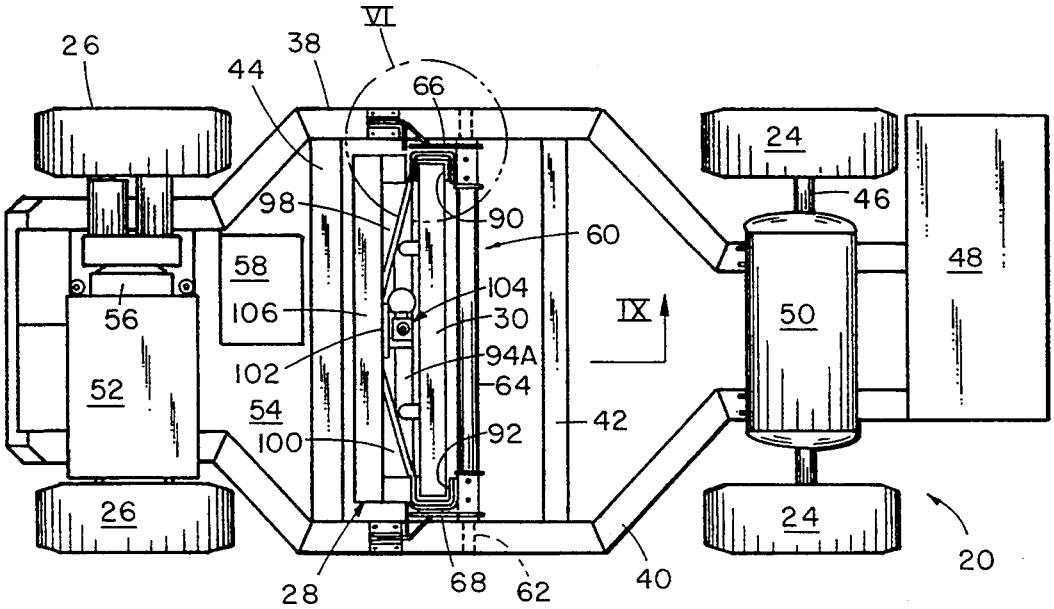
FIG. 5 is a top view of the concrete breaker shown in FIG. 4, the top bracket on the blade frame having been removed to more clearly show components therebelow.
Figure 11:
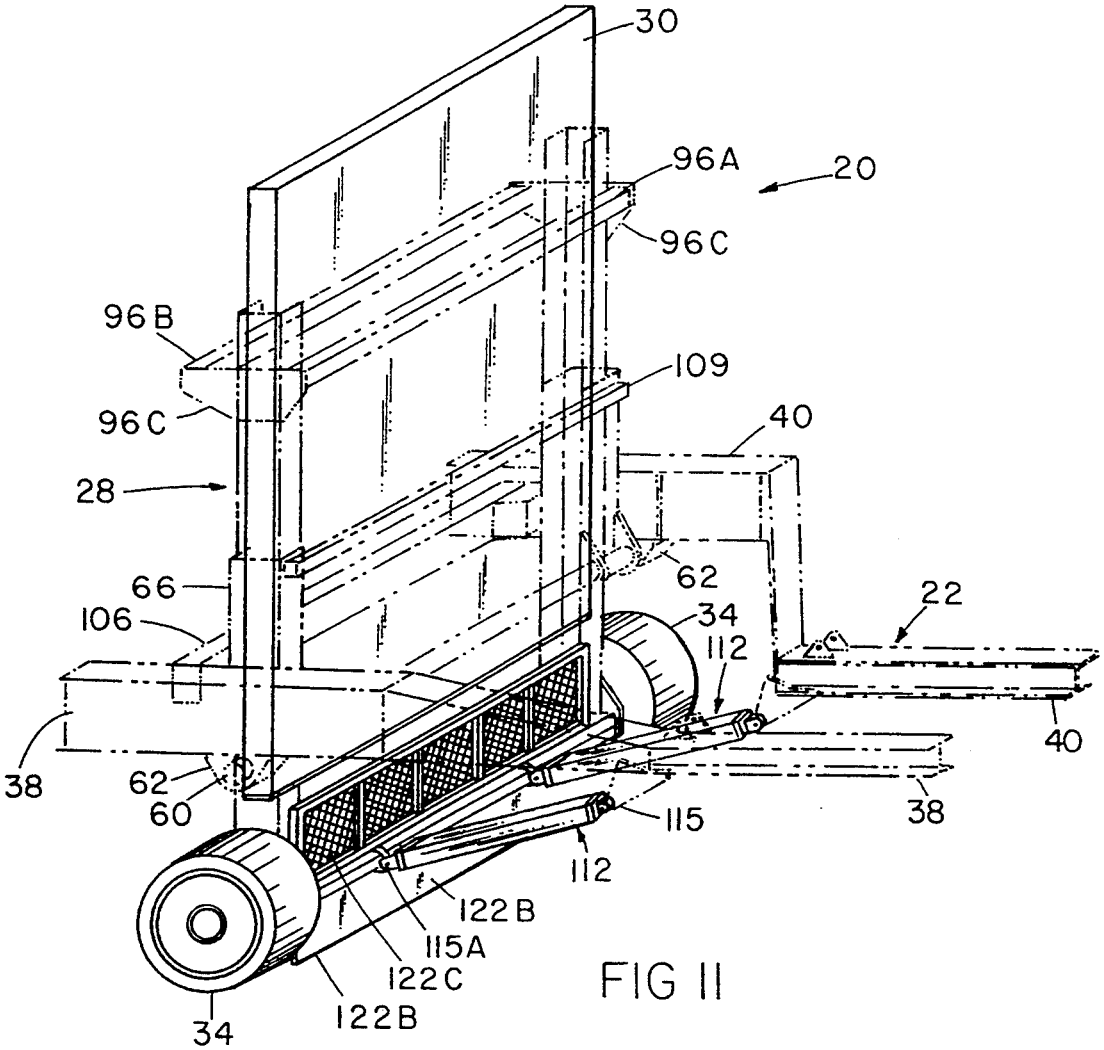
FIG. 11 is a fragmentary perspective view of the blade and blade frame shown in FIG. 9.

Wheeled frame 22 (FIG. 5) includes side frame members 38 and 40 interconnected by cross frame members 42 and 44. A front axle and steering mechanism 46 is secured to the front of side frame members 38 and 40, and front wheels 24 are mounted on mechanism 46. A vehicle cab 48 is also secured to the front of side frame members 38 and 40, and vehicle controls (not specifically shown) such as are well known in the vehicle arts are located in cab 48. A fuel tank 50 is located behind and adjacent cab 48.

A diesel engine 52 is mounted on a platform 54 at the rear of side frame members. Diesel engine 52 is configured to drive one or both of front and rear wheels 24 and 26 by means such as are known in the vehicle arts, such as by hydraulic drives located at each wheel. A hydraulic pump 56 and reservoir 58 are located on platform 54 generally adjacent diesel engine 52, along with a hydraulic system described hereinafter.

A support member 60 (FIGS. 4–5) for supporting blade frame 28 is pivotally connected to side frame members 38 and 40 by bearings 62. Support member 60 includes a shaft 64 that engages bearings 62 and extends between side frame members 38 and 40. Support member 60 further includes a pair of side brackets 66 and 68 secured to each end of tubular shaft 64 inside of and adjacent side frame members 38 and 40. Side brackets 66 and 68 are mirror images of each other, and thus only side bracket 66 will be described in detail below.

Figure 6:
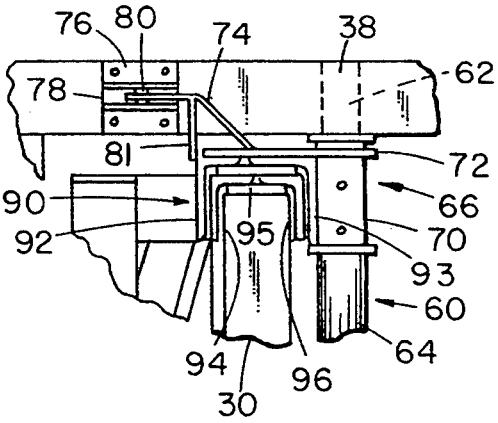
FIG. 6 is a fragmentary enlarged view of the circled area labelled VI in FIG. 5.

Side bracket 66 (FIG. 6) includes a tube engaging end 70, and a plate-shaped member 72 that extends generally parallel the inside of side frame member 38. An arm 74 extends from plate-shaped member 72 over side frame member 38. An anchor bracket 76 is located on side frame member 38 proximate arm 74. Arm 74 includes a hole 78 and anchor bracket 76 includes a hole 80, which holes 78 and 80 are aligned when blade frame 28 is in the upright position so that a bolt (not shown) can be extended through holes 78 and 80 to secure blade frame 28 in the upright position. Web 81 reinforces arm 74 on plate 72.

Figure 6A:
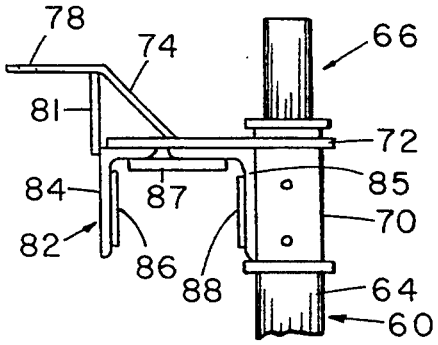
FIG. 6A is a fragmentary plan view of the support member shown in FIG. 6.
Figure 7:
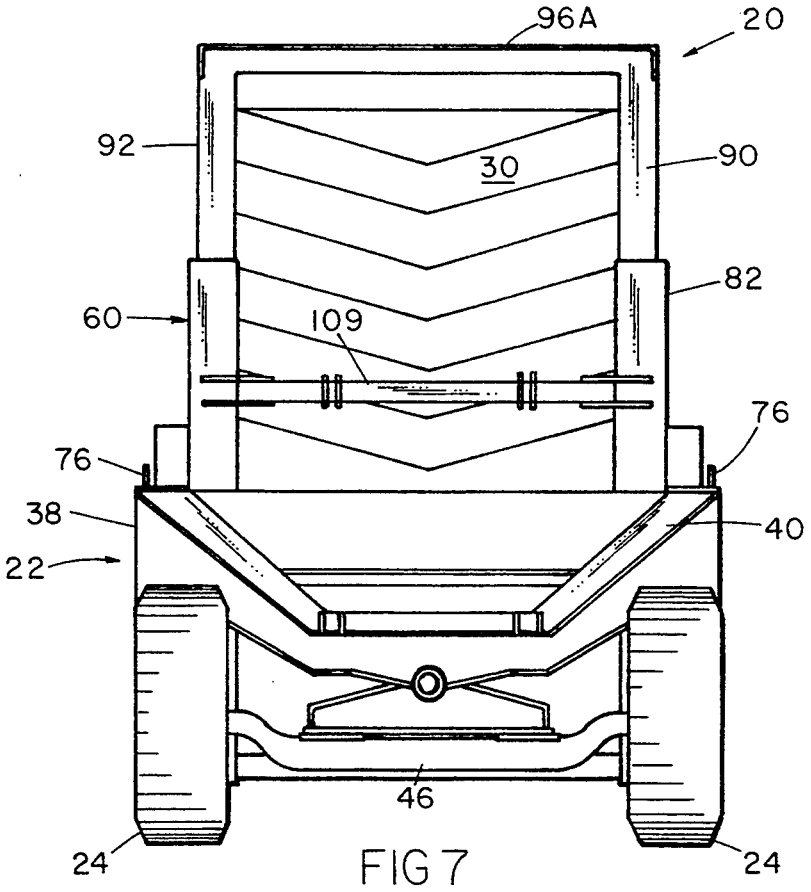
FIG. 7 is a front view of the concrete breaker shown in FIG. 4, the cab and fuel tank of the concrete breaker having been removed to better show the blade and blade frame.
Figure 8:
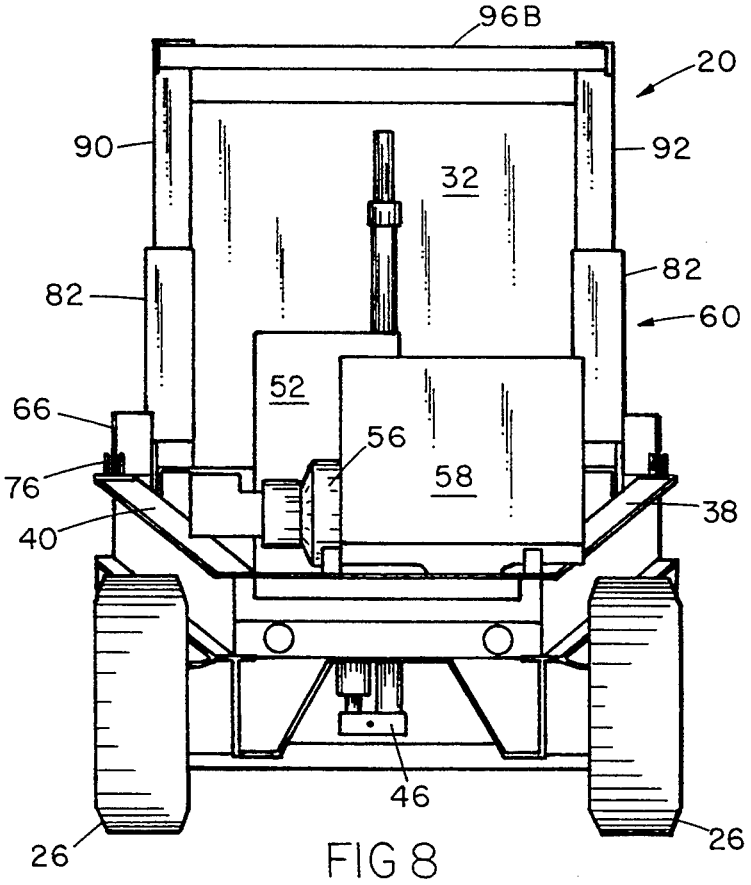
FIG. 8 is a rear elevational view of the concrete breaker shown in FIG. 4.

A U-shaped channel 82 (FIG. 6A) includes a pair of angle beams 84 and 85 and three elongated plates 86, 87 and 88 welded together to define an inwardly facing channel for mateably receiving a second U-shaped channel 90 (FIG. 6) on blade frame 28. Channels 82 of side brackets 66 and 68 (FIG. 1) are interconnected by at least one intermediate cross beam 109 to rigidify support member 60. Second U-shaped channel 90 (FIG. 6) is slideably positioned in first channel 82. Second channel 90 includes a pair of angled beams 92 and 93 and three elongated plates 94, 95 and 96 which define a second inwardly facing channel for slideably receiving blade 30.

Figure 9:
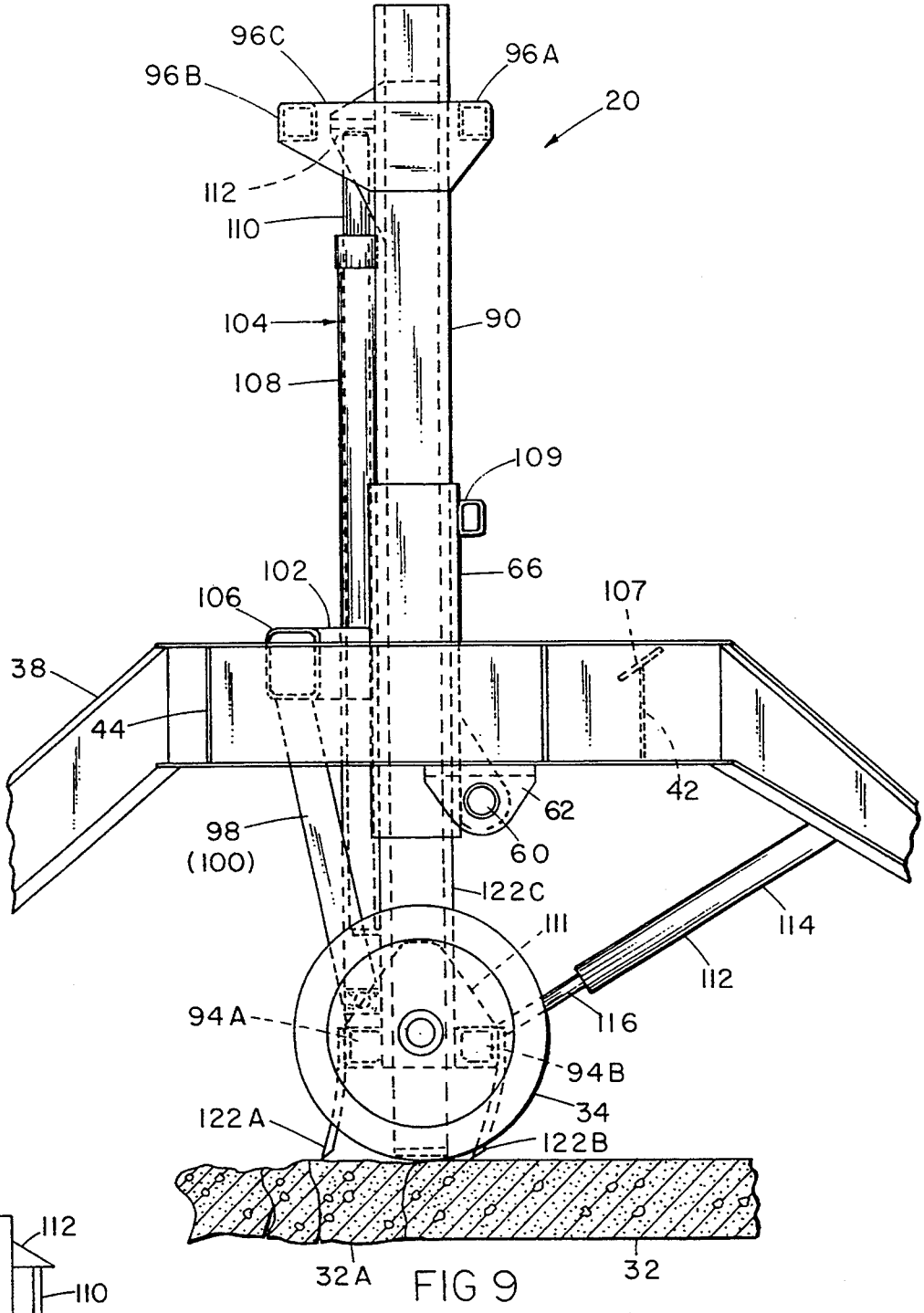
FIG. 9 is an enlarged fragmentary side view of the blade and blade frame shown in FIG. 4.

Blade frame 28 (FIG. 5) includes the U-shaped channel 90 on one side and further includes a corresponding U-shaped channel 92 that is a mirror image of channel 90 on its other side. Channels 90 and 92 are interconnected at the bottom by bottom cross beams 94A and 94B (FIG. 9). Channels 90 and 92 are further interconnected by top beams and 96A and 96B and connecting brackets 96C. (See also FIGS. 1–2.) Diagonal braces 98 and 100 (FIGS. 5 and 9) extend upwardly from bottom cross beam 94A and interconnect to support an intermediate transverse beam 106. Diagonal braces 98 and 100 rigidify blade frame 28.

Wheels 34 are operably mounted at the lower end of channels 90 and 92 and bottom cross beams 94A and 94B by a structural bracket 111 so that the wheels 34 engage concrete 32 under blade frame 28 when blade frame 28 is in the upright position. Blade frame 28 is permitted to move or float relative to wheeled frame 22 (i.e. slide vertically within channels 82 on side brackets 66 and 68) to reduce communication of shocks and vibration from blade 30 through blade frame 28 to wheeled frame 22. Wheels 34 further support the working weight of blade frame 28 and blade 30. However, when blade frame 28 and blade 30 are ready to be pivoted to the transport/storage position, a releasable stop (not specifically shown) can be engaged with blade frame 28 so that blade frame 28 cannot telescopingly slide out the bottom of pivot forming member 60. The stop includes a first shaft or bolt that extends through alignable holes in channel 90, side bracket 66, and blade 30, and a second bolt that extends through alignable holes in channel 92, side bracket 68, and the other side of blade 30. A second stop 107 is located on side frame members 38 and 40 (FIG. 3). Notably, the center of gravity of blade frame 28 and blade 30 moves over the axis of rotation defined by bearings 62 as blade frame 28 and blade 30 are moved between the use and transport positions. This over-center relationship causes the blade frame 28 and blade 30 to stably rest in either the upright position or the storage position.

Figure 2:
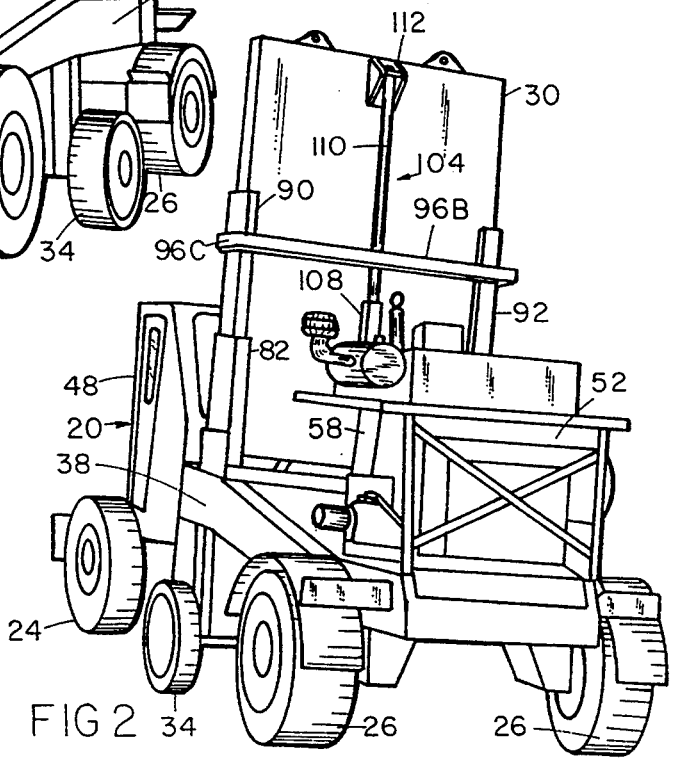
FIG. 2 is a rear perspective view of the concrete breaker shown in FIG. 1, the blade being shown in an upright and lifted position.

Lift cylinder assembly 104 (FIG. 9) includes a cylinder 108 secured to blade frame bottom cross beam 94A, and further includes an extendable rod 110 operably connected to blade 30 by bracket 112 (FIG. 2). Lift cylinder assembly 104 is located between transverse beam 106 and blade 30 such that, when rod 110 is fully extended and blade 30 is raised to a maximum height, the transverse beam 94A supports cylinder assembly 104. It is noted that blade 30 can be upwards of 15,000 pounds, and that the overall gross weight of breaker 20 can be upwards of 30,000 pounds.

A pair of actuator mechanisms or blade pivoting cylinder assemblies 112 (FIG. 4) are connected between the front of wheeled frame 22 and transverse beam 94B. Each cylinder assembly 112 includes a cylinder 114 pivotally connected to wheeled frame 22, and an extendable rod 116 pivotally connected to transverse beam 94B by a hinged joint 115A. By extending and retracting rod 116 in cylinder 114, blade frame 28 and support member 60 are pivoted between an upright portion (FIG. 4) and a retracted position (FIG. 3), respectively. Notably, since cylinder assembly 112 extends between the front of wheeled frame 22 and blade frame wheels 34, it acts like a draw bar to overcome torque generated on blade frame 28 as wheels 34 engage rough terrain, such as broken concrete 32A. Resilient canvas or rubber flaps 122A and 122B (FIG. 9) are secured to bottom cross beams 94A and 94B along with safety guards 122C. Flaps or safety guards 122A and 122B drape downwardly onto cement 32 on either side of blade 30 and thus reduce flying debris generated when blade 30 contacts cement 32.

Figure 4:
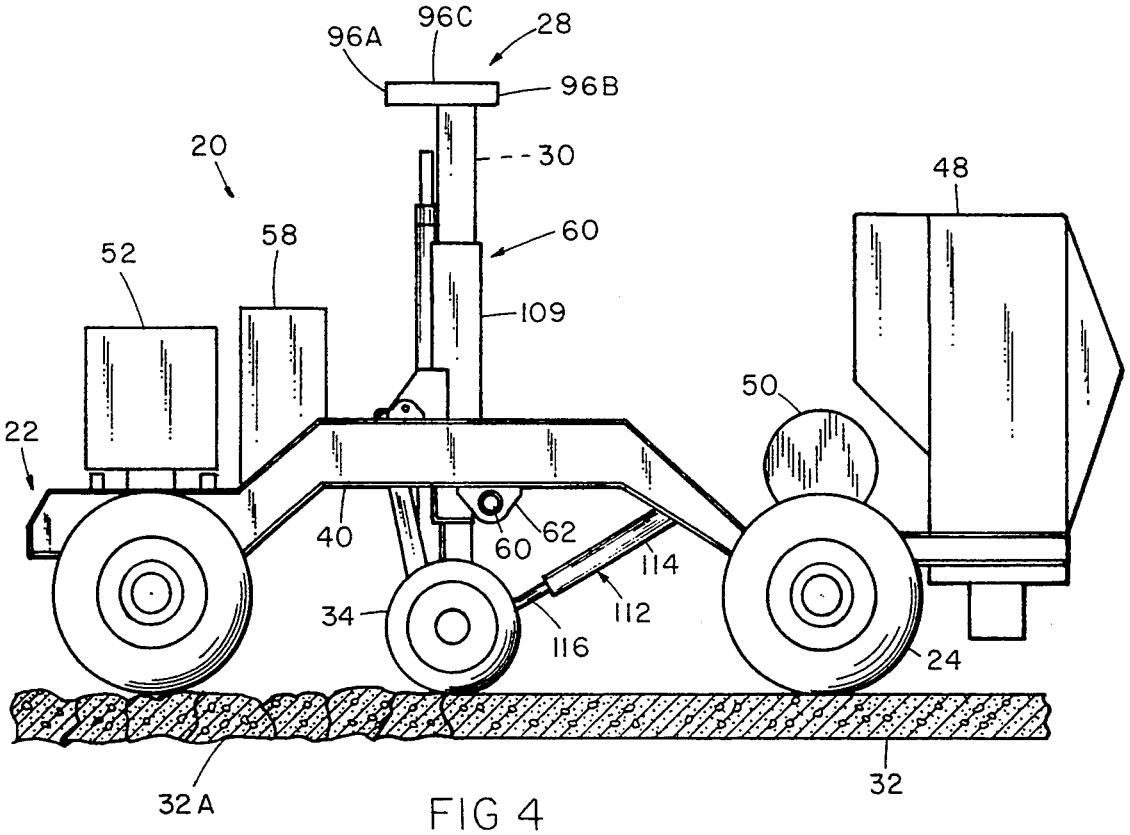
FIG. 4 is a side view comparable to FIG. 3 but with the blade and blade frame being shown in the upright position.
Figure 10:
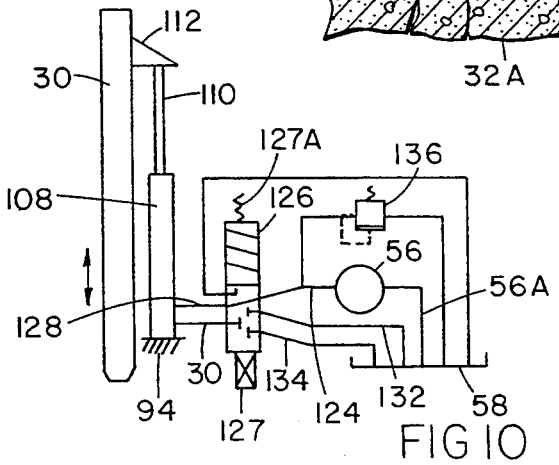
FIG. 10 is a hydraulic schematic for the concrete breaker shown in FIG. 1.

The hydraulic system for actuating the lift cylinder assembly 104 is schematically shown in FIG. 10. Notably, a number of different hydraulic arrangements are contemplated, only one of which is shown. Blade 30 is illustrated as operably connected to rod 110 by bracket 112, and cylinder 108 is supported by blade frame beam 94A. Hydraulic pump 56 is operably connected to hydraulic fluid reservoir 58 by a line 56A for receiving a supply of hydraulic fluid therefrom. Pump 56 communicates pressurized hydraulic fluid through a line 124 to a valve 126. Valve 126 is shiftable by a solenoid 127 to a blade lifting position (shown) and is spring returned to a blade dropping position by a spring 127A. In the blade lifting position, pressurized hydraulic fluid is communicated through a two inch line 128 to the lower end of cylinder 108 for extending rod 110. A second two inch line 130 connected to the lower end of cylinder 108 is blocked by valve 126 when in the blade lifting position. When rod 110 reaches the fully extended position, valve 126 is shifted to the blade dropping position. In the blade dropping position, valve 126 connects both lines 128 and 130 to two inch drain lines 132 and 134, respectively, so that there is substantially no hydraulic restriction when dropping blade 30. Thus, maximum energy is retained in blade 30 for busting up concrete 32 into broken concrete 32A (FIG. 4). A relief valve 136 is provided on line 124 to prevent over-pressure of pump 56.

Thus, there is provided a concrete breaker wherein an independently supported blade and blade frame are provided to reduce vibrational forces transmitted to the main wheeled frame of the breaker. Further, the blade and blade frame are pivotable over-center across the pivot axis of rotation such that the blade is held in a stable position between the front and rear wheels of the vehicle for transport.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A concrete breaker comprising:

a wheeled frame including front and rear wheels;

a blade frame pivotally mounted to said wheeled frame between said front and rear wheels;

a moveable blade operably mounted to said blade frame for breaking concrete;

a lift mechanism operably connected to said blade for lifting said blade; and said blade frame being moveable between an upright position for using said blade and a transport position facilitating transport of said concrete breaker.

2. A concrete breaker as defined in claim 1 including a blade frame support for pivotally mounting said blade frame to said wheeled frame, said blade frame being operably mounted to said support to allow said blade frame to move relative to said wheeled frame to thus reduce transmission of vibrational loads from said blade through said blade frame to said wheeled frame.

3. A concrete breaker as defined in claim 2 wherein said blade frame includes a first pair of opposing channels with capture said blade therebetween, and wherein said support includes a second pair of opposing channels that capture said first pair of channels but permit said blade frame to float within said second pair of channels to reduce transmission of loads from said blade frame to said wheel frame.

4. A concrete breaker as defined in claim 1 wherein said blade frame includes blade frame wheels for supporting the working weight of said blade frame when said blade frame is in said upright position.

5. A concrete breaker as defined in claim 4 including a draw-bar simulating member connected between said blade frame wheels and said front wheels of said wheeled frame.

6. A concrete breaker as defined in claim 4 including a draw-bar simulating member connecting said blade frame to said wheeled frame for overcoming torsional force caused by resistance of said blade frame wheels as said blade frame wheels roll over rough terrain such as broken concrete.

7. A concrete breaker as defined in claim 6 wherein said blade frame defines an axis of rotation as said blade frame is moved between said upright position and said transport position, said draw bar being connected to said 1Made frame in a location spaced below said access of rotation.

8. A concrete breaker as defined in claim 1 wherein said blade frame includes a pivot for pivotally mounting said blade frame to said wheeled frame, said pivot defining an axis of rotation as said blade frame is moved between said upright position and said transport position, said blade frame and said blade having a center of mass that travels over-center of said axis of rotation when moved between said upright position and said transport position such that said blade frame and said blade are located in a stable position when in said transport position.

9. A concrete breaker as defined in claim 1 including an engine operably connected to said rear wheels for propelling said wheeled frame.

10. A concrete breaker as defined in claim 9 wherein said engine is operably connected to said front and rear wheels for powering said front and rear wheels in a four wheel drive arrangement.

11. A concrete breaker as defined in claim 9 wherein said blade weighs about 15,000 pounds.

12. A concrete breaker as defined in claim 1 including a hydraulic tilt mechanism connected to said blade frame for moving said blade frame between said upright position and said transport position.

13. A concrete breaker as defined in claim 1 wherein said lift mechanism includes a lift cylinder and an extendable cylinder rod operably connected to said blade frame and said blade for lifting said blade, and further includes a hydraulic system comprising:

a hydraulic fluid pump, a hydraulic fluid reservoir connected to said pump, a first hydraulic line for communicating pressurized hydraulic fluid from said pump to said lift cylinder to extend said rod and thus lift said blade, a second hydraulic line operably connected to said lift cylinder for exhausting hydraulic fluid when retracting said rod, and a valve operably connected to said first and second lines, said valve being shiftable to a lift position wherein said first hydraulic line is open and said second hydraulic line is blocked such that pressurized hydraulic fluid can be communicated to said lift cylinder by said pump, said valve further being shiftable to an exhaust position wherein both of said first and second lines are vented to said hydraulic fluid reservoir such that said blade will drop without significant restriction from hydraulic fluid being exhausted from said cylinder.

14. A concrete breaker as defined in claim 1 wherein said blade weighs about 15,000 pounds.

15. A concrete breaker as defined in claim 1 including a safety guard located on a lower end of said blade frame for containing flying debris thrown from said blade when said blade contacts and breaks cement.

16. A concrete breaker as defined in claim 15 including a pair of said safety guards which are located on opposite sides of said blade.

17. A concrete breaker as defined in claim 15 wherein said safety guard includes a flap of resilient material.

18. A concrete breaker as defined in claim 1 wherein said blade frame is mounted to said wheeled frame about midway between said front and rear wheels in a balanced position which facilitates stable movement of said wheeled frame when said blade frame is in said upright position and when in said transport position.

19. A concrete breaker as defined in claim 1 including a pair of said front wheels, and wherein said front wheels are steerable.

20. A concrete breaker as defined in claim 19 wherein said blade weighs about 15,000 pounds.

21. A concrete breaker comprising:

a wheeled frame;

a blade for breaking concrete operably supported by said wheeled frame; and a lift mechanism for lifting said blade, said lift mechanism comprising a lift cylinder supported by said wheeled frame, an extendable cylinder rod mounted in said lift cylinder and operably connected to said blade for lifting said blade, a hydraulic fluid pump, a motor for operating said pump, a hydraulic fluid reservoir operably connected to said pump, a first hydraulic line for communicating pressurized hydraulic fluid to said lift cylinder to extend said rod and thus lift said blade, a second hydraulic line operably connected to said lift cylinder for exhausting hydraulic fluid when retracting said rod, and a valve operably connected to said first and second lines, said valve being shiftable to a lift position wherein said first hydraulic line is open and said second hydraulic line is blocked such that pressurized hydraulic fluid can be communicated to said lift cylinder by said pump, said valve further being shiftable to an exhaust position wherein both of said first and second lines are exhausted such that said blade will drop without significant restriction from the hydraulic fluid being exhausted from said cylinder.

22. A concrete breaker as defined in claim 21 including a blade frame on said wheel frame for carrying said blade, said subframe including blade frame wheels for engaging the terrain below said blade frame to carry the working weight of said blade and said blade frame when using said concrete breaker.

23. A concrete breaker comprising:

a wheeled frame including a guide;

a blade slideably mounted in said guide for breaking concrete;

a lift mechanism for lifting said blade; and a chip guard attached to said wheeled frame, said chip guard being located proximate a lower end of said guide for obstructing flying debris thrown when said blade contacts cement for breaking the cement.

24. A concrete breaker as defined in claim 23 including a pair of said chip guards which are located on opposite sides of said blade.

25. A concrete breaker as defined in claim 23 wherein said chip guard includes a flap of flexible material.

26. A concrete breaker as defined in claim 23 wherein said wheeled frame includes front and rear wheels, and including a blade frame mounted to said wheeled frame about midway between said front and rear wheels in a balanced position which facilitates stable movement of said wheeled frame when said blade frame is in said upright position and in said transport position.

27. A concrete breaker for breaking concrete sections comprising: a main frame;

a blade frame, said main frame including supports for slideably supporting said blade frame in said upright position for independent vertical movement;

a blade slideably mounted to said blade frame;

terrain engaging structure on said blade frame for movably supporting said blade frame on the concrete sections independent of said main frame; and a lift mechanism operably connected to said blade for lifting said blade.

28. A concrete breaker as defined in claim 27 wherein said terrain engaging structure includes wheels on said supports.

29. A concrete breaker comprising:

a wheeled frame;

a blade frame pivotally connected to said wheeled frame for movement between an operating position and an angled transport position, said blade frame including terrain engaging structure movably supporting the working weight of said blade frame on terrain below said blade frame when in said operating position;

a concrete busting blade operably connected to said blade frame; and a draw bar connecting said blade frame to said wheeled frame for overcoming torsional force on said blade frame caused by resistance of said terrain engaging structure as said terrain engaging structure moves over terrain below said blade frame.

30. A concrete breaker as defined in claim 29 wherein said terrain engaging structure includes terrain engaging wheels.

31. A concrete breaker comprising:

a main frame including a pair of spaced frame side members and further including a pair of from wheels and a pair of rear wheels supporting said main frame;

a blade frame;

a concrete busting blade operably connected to said blade frame and having sufficient mass for effectively busting concrete, said blade extending between said pair of spaced frame side members and being located between said pairs of front and rear wheels; and a pivot pivotally mounting said blade frame to said main frame for movement between an upright position for use and a storage position, said pivot defining an axis of rotation as said blade frame is moved between said upright position and said transport position, said blade frame and said blade having a center of mass that travels over-center of said axis of rotation when moved between said upright position and said transport position such that said blade frame and said blade are located in a stable position when in said transport position.

32. A concrete breaker as defined in claim 31 wherein said main frame is portably supported on wheels.

33. A concrete breaker as defined in claim 31 wherein said concrete busting blade weighs at least about 15,000 pounds.

34. A lift mechanism for lifting and dropping a blade, comprising:

a lift cylinder, an extendable cylinder rod mounted in said lift cylinder and operably connected to said blade for lifting said blade, a hydraulic fluid pump, a motor for operating said pump, a hydraulic fluid reservoir operably connected to said pump, a first hydraulic line for communicating pressurized hydraulic fluid to said lift cylinder to extend said rod and thus lift said blade, a second hydraulic line operably connected to said lift cylinder for exhausting hydraulic fluid when retracting said rod, and a valve operably connected to said first and second lines, said valve being shiftable to a lift position wherein said first hydraulic line is open and said second hydraulic line is blocked such that pressurized hydraulic fluid can be communicated to said lift cylinder by said pump, said valve further being shiftable to an exhaust position wherein both of said first and second lines are exhausted such that said blade will drop without significant restriction from the hydraulic fluid being exhausted from said cylinder.

35. A method of breaking concrete comprising:

supporting a main frame on front and rear wheels;

slideably supporting a blade frame on said main frame between said front and rear wheels in an upright operating position;

slideably supporting a blade on said blade frame for busting concrete; and independently supporting said blade frame on the concrete sections being broken when operating said blade and where moving the main frame over the concrete sections.

* * * * *